US009291418B2

(12) United States Patent
McNitt

(10) Patent No.: US 9,291,418 B2
(45) Date of Patent: Mar. 22, 2016

(54) GUN STANDOFF DEVICE

(71) Applicant: Frank Edward McNitt, Woodland Hills, UT (US)

(72) Inventor: Frank Edward McNitt, Woodland Hills, UT (US)

( * ) Notice: Subject to any disclaimer, the term of this patent is extended or adjusted under 35 U.S.C. 154(b) by 0 days.

(21) Appl. No.: 14/319,589

(22) Filed: Jun. 30, 2014

(65) Prior Publication Data

US 2015/0013204 A1 Jan. 15, 2015

Related U.S. Application Data

(63) Continuation-in-part of application No. 14/120,424, filed on Sep. 10, 2013, now abandoned, and a continuation-in-part of application No. 14/120,417, filed on Jun. 28, 2013, now abandoned.

(51) Int. Cl.
*F41A 21/32* (2006.01)
*F41C 27/16* (2006.01)

(52) U.S. Cl.
CPC ..... *F41A 21/32* (2013.01); *F41C 27/16* (2013.01)

(58) Field of Classification Search
USPC ..... 42/90, 85, 86, 1.06, 79, 53; 89/14.2–14.5
See application file for complete search history.

(56) References Cited

U.S. PATENT DOCUMENTS 2,870,679 A * 1/1959 Collins ..... 89/14.2
2,900,875 A * 8/1959 Fergus et al. ..... 89/14.3
3,226,871 A * 1/1966 Sargeant et al. ..... 42/79
5,005,463 A * 4/1991 A'Costa ..... 89/14.2
D349,147 S 7/1994 Gwinn, Jr.
5,661,255 A * 8/1997 Webb, III ..... 89/14.05
5,773,746 A 6/1998 Vaden
5,883,328 A 3/1999 A'Costa
6,142,058 A * 11/2000 Mayville et al. ..... 89/126
6,234,058 B1 * 5/2001 Morgado ..... 89/33.03
6,557,290 B2 5/2003 Kumler
6,565,226 B1 * 5/2003 Cummings ..... 362/110
6,782,651 B1 8/2004 Walker et al.
6,990,764 B2 1/2006 Walker
7,032,340 B2 4/2006 Baber et al.
D610,221 S 2/2010 Brittingham
7,661,349 B1 2/2010 Brittingham
7,854,085 B1 * 12/2010 Hodgkins et al. ..... 42/85
7,861,636 B1 * 1/2011 Hoffman ..... 89/14.2
7,891,282 B1 2/2011 DeGroat
8,336,459 B1 * 12/2012 Gould ..... 102/336
D677,357 S 3/2013 Dueck et al.
8,418,393 B1 4/2013 Powers
8,418,592 B1 4/2013 Gonstad et al.
8,424,441 B2 4/2013 Brittingham et al.
D682,972 S 5/2013 KasanJian-King
8,490,534 B1 * 7/2013 Moore ..... 89/14.2
8,656,621 B2 * 2/2014 Chvala ..... 42/71.01

(Continued)

OTHER PUBLICATIONS

U.S. Appl. No. 14/120,424, filed Sep. 10, 2013, McNitt.

(Continued)

*Primary Examiner* — Michael David
(74) *Attorney, Agent, or Firm* — Workman Nydegger

(57) ABSTRACT

A gun standoff device may include an elongated body having crenulations at a first end and an attachment mechanism at a second end. The crenulations at the first end may provide a plurality of radially disposed teeth about the circumference of the first end. The attachment mechanism may allow attachment of the elongated body to a gun barrel, a gun magazine, or other gun component.

19 Claims, 19 Drawing Sheets

(56) References Cited

U.S. PATENT DOCUMENTS

| | | | | |
|---|---|---|---|---|
| 8,782,942 | B1 * | 7/2014 | Bentley | 42/75.01 |
| 2005/0108916 | A1 | 5/2005 | Keeney et al. | |
| 2012/0144712 | A1 * | 6/2012 | Rostocil | 42/16 |
| 2014/0190058 | A1 * | 7/2014 | Ballard | 42/90 |

OTHER PUBLICATIONS

U.S. Appl. No. 14/120,417, filed Jun. 28, 2013, McNitt.

Vangcompsystems.com; Shotgun standoff device (Breaching); https://vangcomp.com/Standoff_Device.html; Date Accessed Jun. 3, 2013; 2 pages.

Briley.com; Briley Breach Buster; http://www.briley.com/brileybreachbuster.aspx; Date Accessed Jun. 3, 2013; 2 pages.

Tactical-Life; Mossberg 500 thunder Ranch 12 Gauge Shotgun Review; http://www.tactical-life.com/guns-and-weapons/mossberg-500-thunder-ranch-12-ga/; Date Accessed Jun. 3, 2013; 2 pages.

armslist.com; For Sale: Shotgun Standoff for Remington 870, Mossberg 590 & Similar; http://www.armslist.com/posts/1519001/utah-gun-arts-for-sale--shotgun-standoff-for-remington-870--mossberg-590---similar-; Date Accessed Jun. 3, 2013; 3 pages.

* cited by examiner

GUN STANDOFF DEVICE

CROSS-REFERENCE TO RELATED APPLICATIONS

The present application is a continuation in part of U.S. patent application Ser. No. 14/120,424, filed Sep. 10, 2013, and entitled "GUN STANDOFF DEVICE", and is a continuation in part of U.S. patent application Ser. No. 14/120,417, filed Jun. 28, 2013, entitled "STANDOFF DEVICE FOR A GUN", the disclosures of which are each incorporated herein by reference in their entireties.

BACKGROUND

Standoff devices have been developed as attachments to guns to aid in personal and home protection as non-lethal deterrents, or for tactical use by police or military personnel. Standoff devices are capable of providing close-quarters defensive protection when used as a non-firing close-quarters weapon. Additionally, such devices are used to aid in breaching, when a gun is used to gain entry past doors, gates, or other barriers. In this mode of use, a standoff device provides distance from the end of the gun muzzle to the target barrier, in order to keep a user from firing with the muzzle too close to the target and causing damage to the gun barrel and/or injury to the user.

Current standoff devices, however, suffer from several shortcomings. Gun components often vary in construction (i.e. thread pitch, etc.) from manufacturer to manufacturer and from model to model, and a different standoff device is typically required for attachment to any gun made by a different manufacture or even for different series or models of guns made by the same manufacturer. Thus, a specific, custom-tailored standoff device is likely required for any given model and manufacture of gun, requiring a gun owner with several guns to purchase several separate standoff devices matched specifically to each gun.

Additionally, a standoff device (e.g. one that is not designed as part of the barrel) must be long enough to extend beyond the gun barrel to be functional for either close-quarters self-defense or breaching purposes. A typical standoff device is designed to attach to the distal end of a shotgun's stock magazine tube or to the barrel by permanent attachment during manufacturing, by welding, or by varying threaded components. Such a standoff device may not be able to function as a magazine tube extension with all gun models, and a user of such a standoff device may not be unable to obtain the additional ammunition capacity desired. Alternatively, such a standoff device may not allow for the magazine tube extension to operate without the standoff device attached. Thus, for uses where the standoff may not be desired, a user would have to use the magazine tube extension with the standoff device. Furthermore, simply adding a magazine tube extension and connecting the standoff device to the magazine tube extension defeats the purpose of providing close-quarters self-defense because the long length of the standoff device renders the gun unwieldy for any close-quarters self-defense or breaching maneuvers when a magazine tube extension is also used. Thus, a user may often be forced to choose between a manageable length at which the standoff device extends from the gun and extra ammunition capacity.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one non-limiting embodiment, a standoff device includes an elongated body having a proximal end and a distal end. The standoff device includes a bore extending longitudinally therethrough. The elongated body is circumferentially crenelated at the distal end to form more than one tooth members. The tooth members are located radially around the distal end of the elongated body. The standoff device includes an attachment structure at the proximal end of the elongated body. The attachment structure is capable of attaching the standoff device to a component of a gun.

In another non-limiting embodiment, a standoff device for a gun includes an elongated body having a proximal end and a distal end. The standoff device includes a bore extending longitudinally therethrough. The elongated body is circumferentially crenelated at the distal end to form more than one tooth members. The tooth members are located radially around the distal end of the elongated body. The standoff device includes a plurality of ports. Each of the ports extend through the elongated body and provide fluid communication with the bore. The standoff device includes an attachment structure at the proximal end of the elongated body. The attachment structure is capable of attaching the standoff device to a component of a gun.

In yet another non-limiting embodiment, a standoff device for a gun includes an elongated body having a proximal end and a distal end. The standoff device includes a bore extending longitudinally therethrough. The elongated body is circumferentially crenelated at the distal end to form more than one tooth members. The tooth members are located radially around the distal end of the elongated body. The standoff device includes a plurality of ports. Each of the ports extend through the elongated body and provide fluid communication with the bore. The standoff device includes an attachment structure configured to extend circumferentially about a component of a gun. The attachment structure includes a plurality of threaded attachment holes spaced circumferentially about the attachment structure. Each of the threaded attachment holes is configured to receive a threaded set screw.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. While some of the drawings are schematic representations, at least some of the figures may be drawn to scale. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1A:
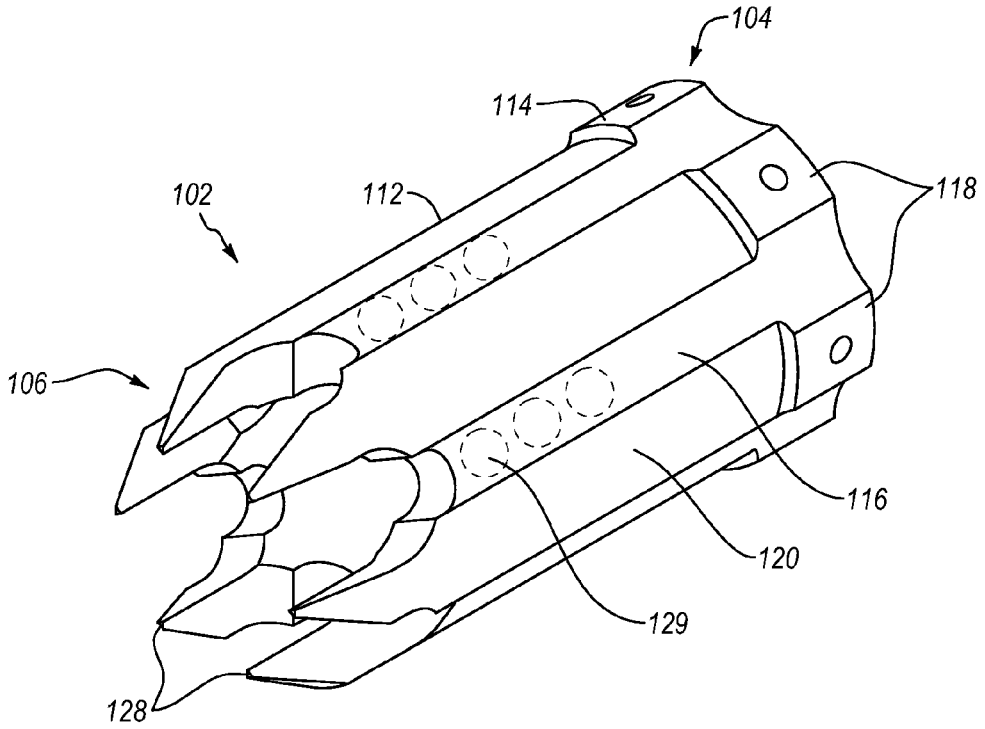
FIG. 1A is a front perspective view of a standoff device having attachment holes according to the present embodiment.

One or more specific embodiments of the present disclosure will be described below. These described embodiments are examples of the presently disclosed techniques. Additionally, in an effort to provide a concise description of these embodiments, not all features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Referring to the embodiment shown in FIGS. 1A-E, a standoff device 102 may include a proximal end 104 and a distal end 106. The standoff device 102 may include a cylindrical bore 108 extending through the standoff device 102 from the proximal end 104 to the distal end 106, the cylindrical bore 108 may be bounded by an inner circumferential surface 110. In other embodiments, the standoff device 102 may not include a cylindrical bore. In further embodiments, the cylindrical bore 108 may extend only partially through the standoff device 102. For example, the cylindrical bore 108 may extend from the proximal end 104 toward the distal end 106 or may extend from the distal end 106 toward the proximal end 104. The device further includes an elongated body 112 disposed between the proximal end 104 and the distal end 106. A collar 114 may also be disposed at the proximal end 104 and extending a distance in the distal direction. The collar 114, in embodiments that exhibit a collar, may be integrally formed with and connected to the elongated body 112 or connected as a separate component.

In some embodiments, the outer circumference of the collar 114 may include a plurality of recesses 116 radially spaced along the circumference so as to form an alternating configuration of recesses 116 and raised perimeter surfaces 118. The recesses 116, in embodiments that exhibit them, may run longitudinally from the collar 114 to the elongated body 112, such that the elongated body 112 also includes the plurality of recesses 116. Alternatively, in embodiments that do not exhibit a collar, the elongated body 112 may include a plurality of recesses 116. The recesses 116 may include a curved surface extending along the length of the recess 116. In other embodiments, the recesses 116 may be flat, stepped, concave, convex, may vary in shape and/or curvature along the length, or may be otherwise shaped. In any of the various embodiments, the elongated body 112 may also include a plurality of primary surfaces 120 radially spaced along the outer circumferential perimeter of the elongated body 112 so as to form an alternating configuration of recesses 116 and primary surfaces 120 along the outer perimeter of the elongated body 112. The primary surfaces 120 may be generally flat. In other embodiments, the primary surfaces 120 may be curved, stepped, concave, convex, may vary in shape and/or curvature along the length, or may be otherwise shaped.

In embodiments where the recesses 116 run longitudinally across a collar 114 and the elongated body 112, the primary surfaces 120 of the elongated body 112 may be concentrically aligned with the raised perimeter surfaces 118 of the collar 114, as shown in FIG. 1. In the embodiment shown in FIG. 1, for example, the portion of the recesses 116 in the collar 114 and the portion of the recesses 116 in the elongated body 112 have the same general curvature. Because the raised perimeter surfaces 118 are raised higher relative to the primary surfaces 120 (i.e. they extend farther radially), the curvature of the portion of the recesses 116 adjacent to the raised perimeter surfaces 118 extends farther than the curvature of the portion of the recesses 116 adjacent to the primary surfaces 120, thereby providing portion of the recesses 116 in the collar 114 with greater lateral width than the portion of the recesses 116 in the elongated body 112. Accordingly, in such an embodiment, the lateral width of the primary surfaces 120 may be greater than the lateral width of the raised perimeter surfaces 118. It should be appreciated, however, that other embodiments may exhibit different and/or varying recess curvatures, if a recess or recesses are used in such a particular embodiment.

The distal end 106 of the standoff device 102 may be crenelated to provide a plurality of tooth members 122 and a plurality of notches 124. The tooth members 122 and notches 124 may be configured in an alternating fashion around the outer circumference of the distal end 106 of the standoff device 102. Each notch 124 may include a valley 126, the valley 126 being the region of the notch 124 at the greatest proximal extension of the notch 124. In the embodiment shown, as an optional example, the notches 124 may be formed with curved contours. The curved contours may generally widen laterally in the distal direction moving outward from the valleys 126. The notches 124 may be centered on the recesses 116, if recesses are exhibited in such an embodiment, such that the greatest distal extension of the recesses 116 ends at the notches 124, the valleys 126 of the notches 124 also optionally being aligned with the longitudinal centerlines of the recesses 116.

In one embodiment, the primary surfaces 120 may extend distally farther than the recesses to form the tooth members 122. Concomitant with the general lateral widening of the notches 124 in the distal direction, if an embodiment exhibits such widening, the tooth members 122 may generally taper laterally in the distal direction to form tooth end points 128. The curvature of the contour of a notch 124 may be substantially the same along the entirety of the notch 124, or it may vary, such that there are multiple curvature values at various portions of the contour of the notch 124, including portions that have no curvature. For example, in one embodiment, as shown in FIG. 1B, the curvature of a distal portion of a notch 124 (e.g. a portion bordering a recess) may be relatively greater than the curvature of the more proximal portions of a notch 124 (e.g. the portions bordering a tooth member), such that there is greater curvature at the valley 126 of the notch relative to other portions of the notch.

The tooth members 122 may also include angled outer tooth surfaces 130. An angled outer tooth surface 130 may be disposed starting at a lateral line 132 on a tooth member a distance in the proximal direction from the tooth end point 128 and extending distally from the lateral line 132 to the tooth end point 128. The angled outer tooth surface 130 may also be configured so as to have a radial extension at the lateral line equal to the radial extension of the surface just proximal the tooth member 122, and a radial extension at the tooth end point 128 less than the radial extension of the surface just proximal the tooth member 122 such that the angled outer tooth surface 130 slopes radially inward along the distal direction.

Figure 1B:
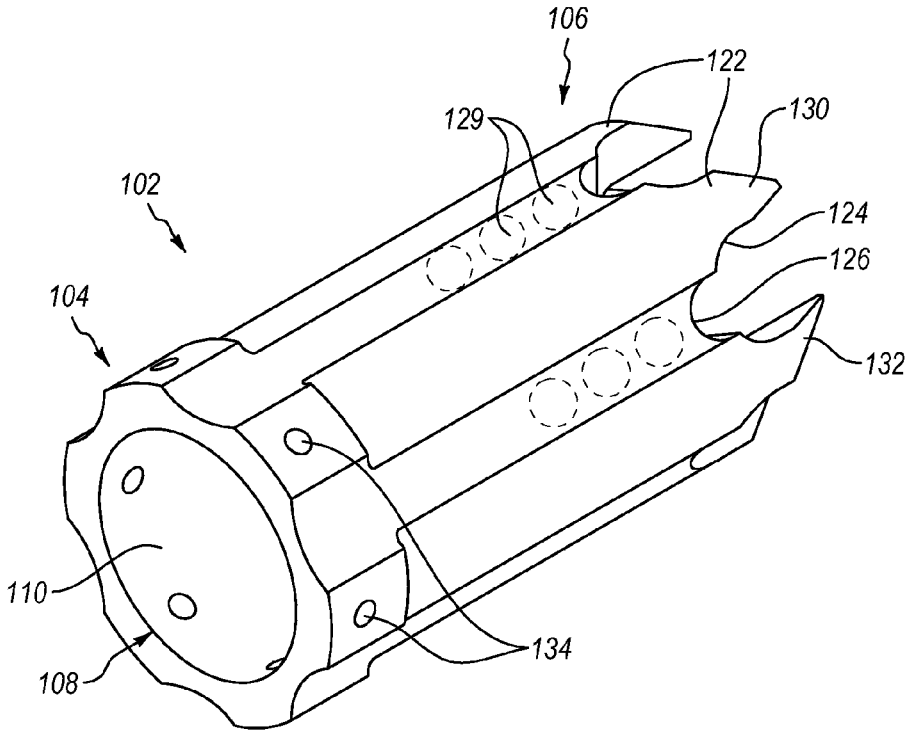
FIG. 1B is a rear perspective view of a standoff device having attachment holes according to the present embodiment.
Figure 1C:
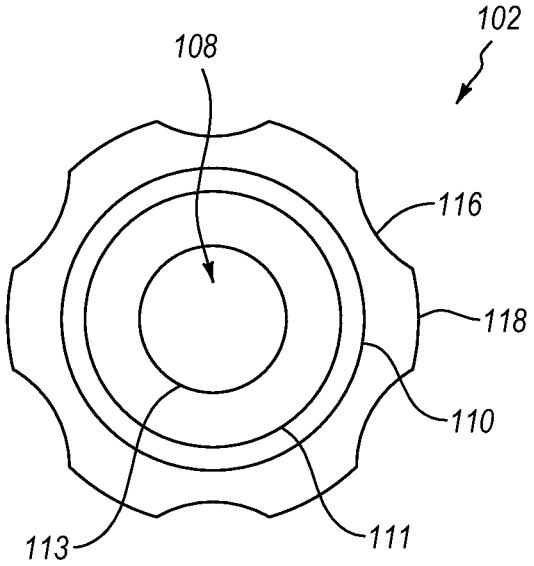
FIG. 1C is a bottom view of a standoff device having attachment holes according to the present embodiment.
Figure 1D:
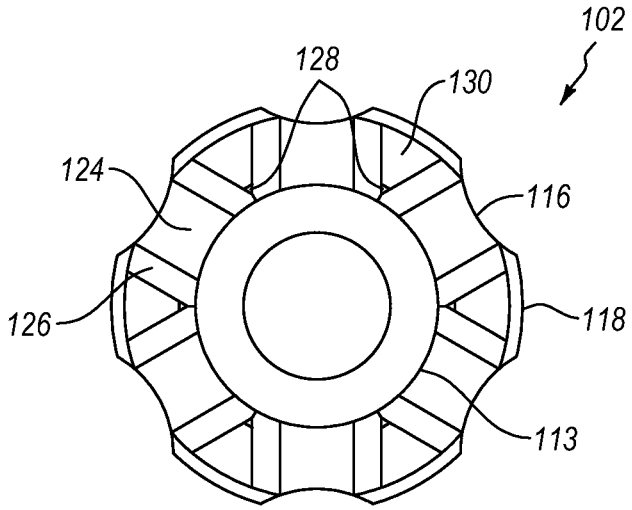
FIG. 1D is a top view of a standoff device having attachment holes according to the present embodiment.
Figure 1E:
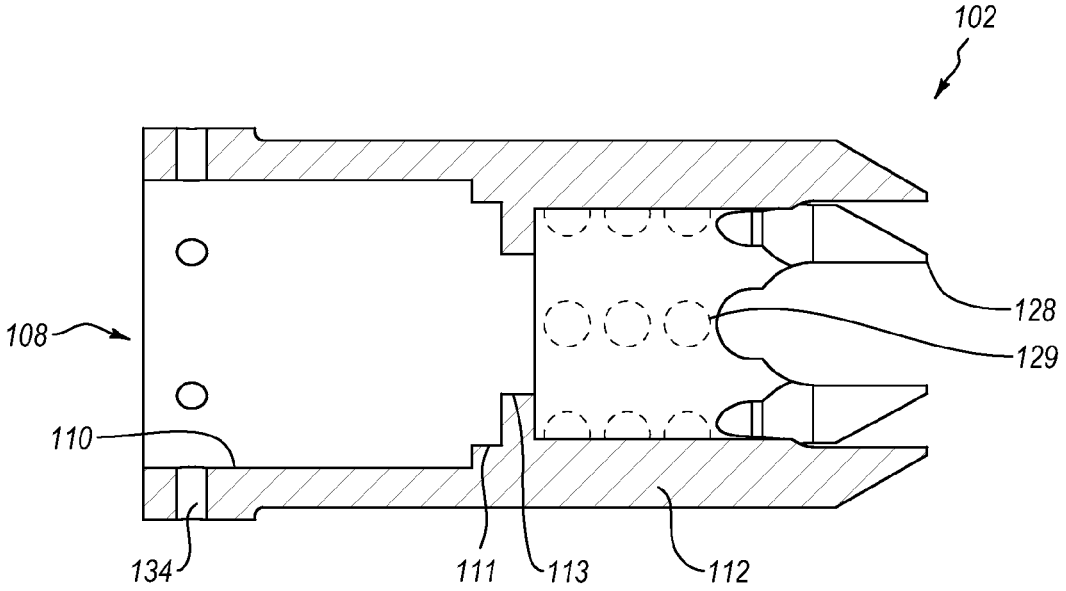
FIG. 1E is a cross-sectional side view of a standoff device having attachment holes according to the present embodiment.
Figure 2A:
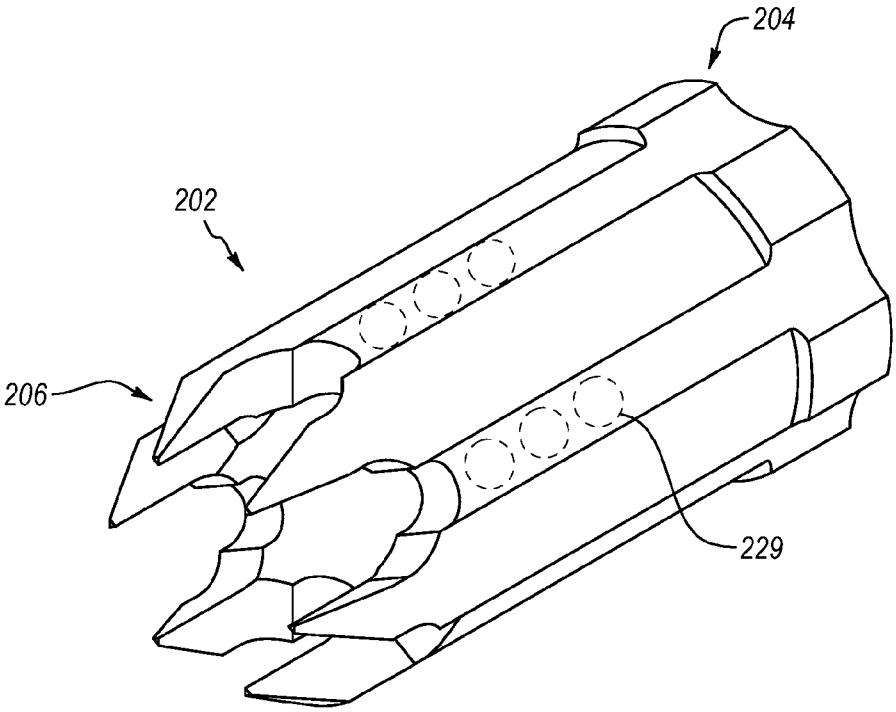
FIG. 2A is a front perspective view of a standoff device having a threaded interior surface according to the present embodiment.
Figure 2B:
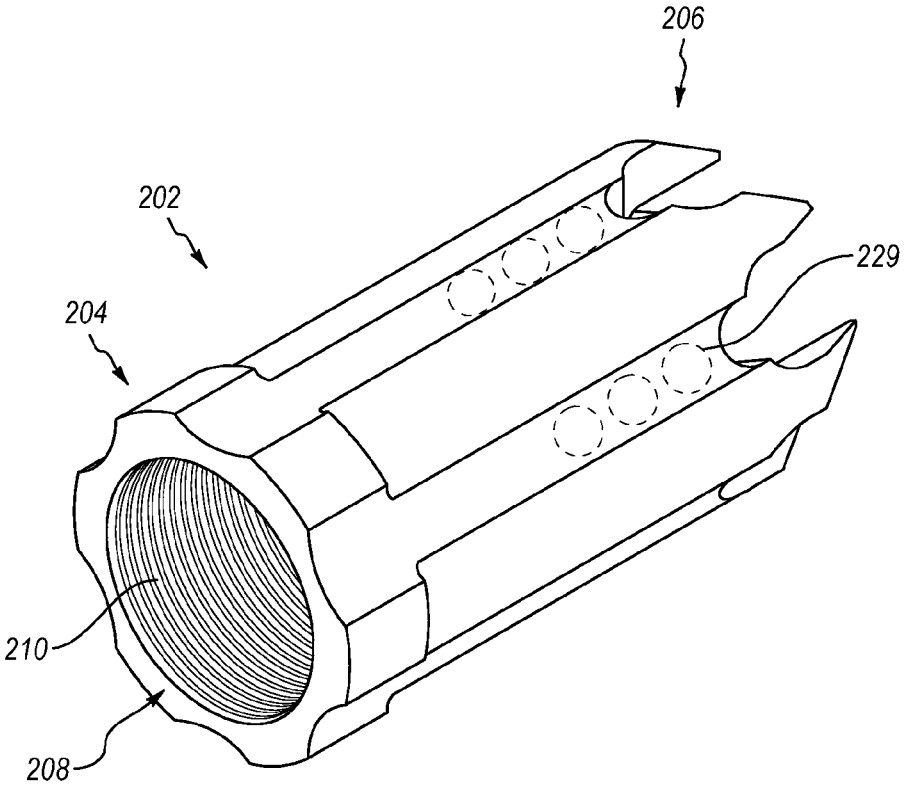
FIG. 2B is a rear perspective view of a standoff device having a threaded interior surface according to the present embodiment.
Figure 2C:
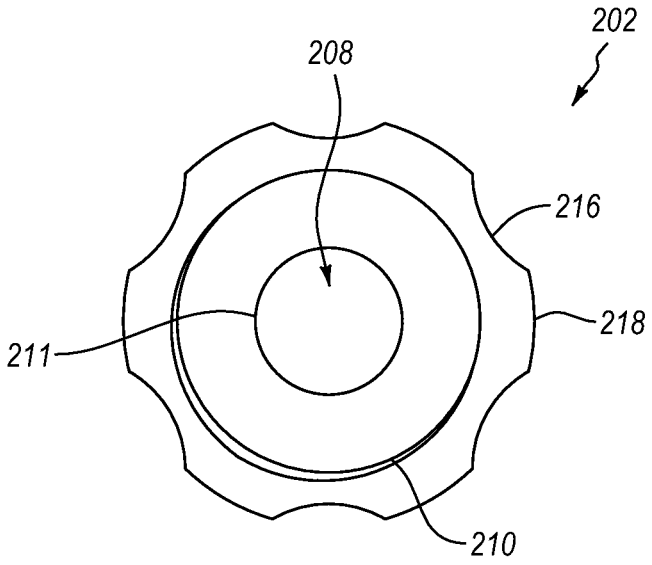
FIG. 2C is a bottom view of a standoff device having a threaded interior surface according to the present embodiment.
Figure 2D:
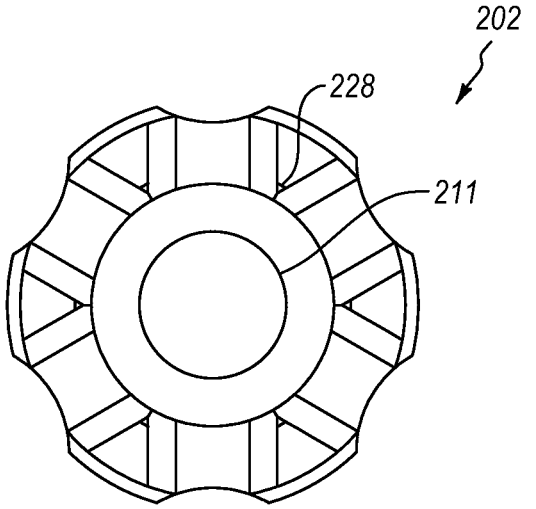
FIG. 2D is a top view of a standoff device having a threaded interior surface according to the present embodiment.
Figure 2E:
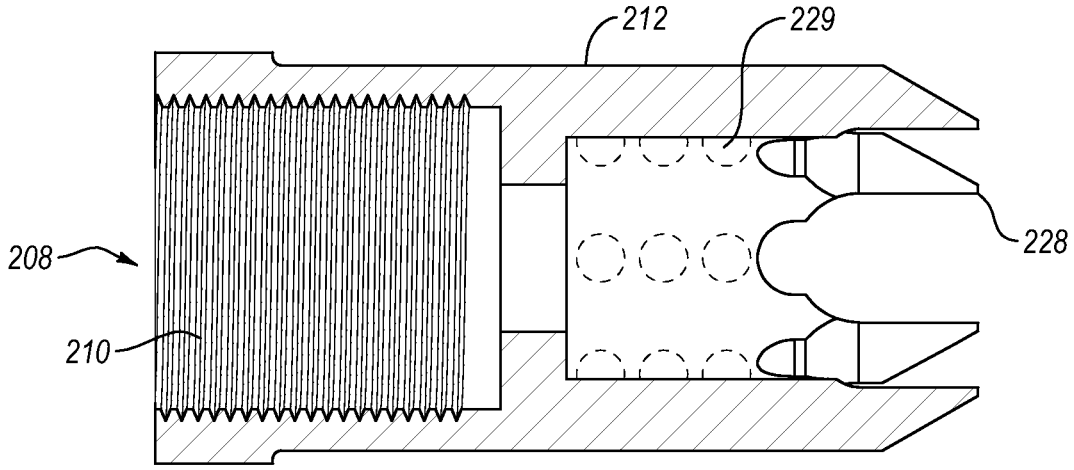
FIG. 2E is a cross-sectional side view of a standoff device having a threaded interior surface according to the present embodiment.
Figure 3A:
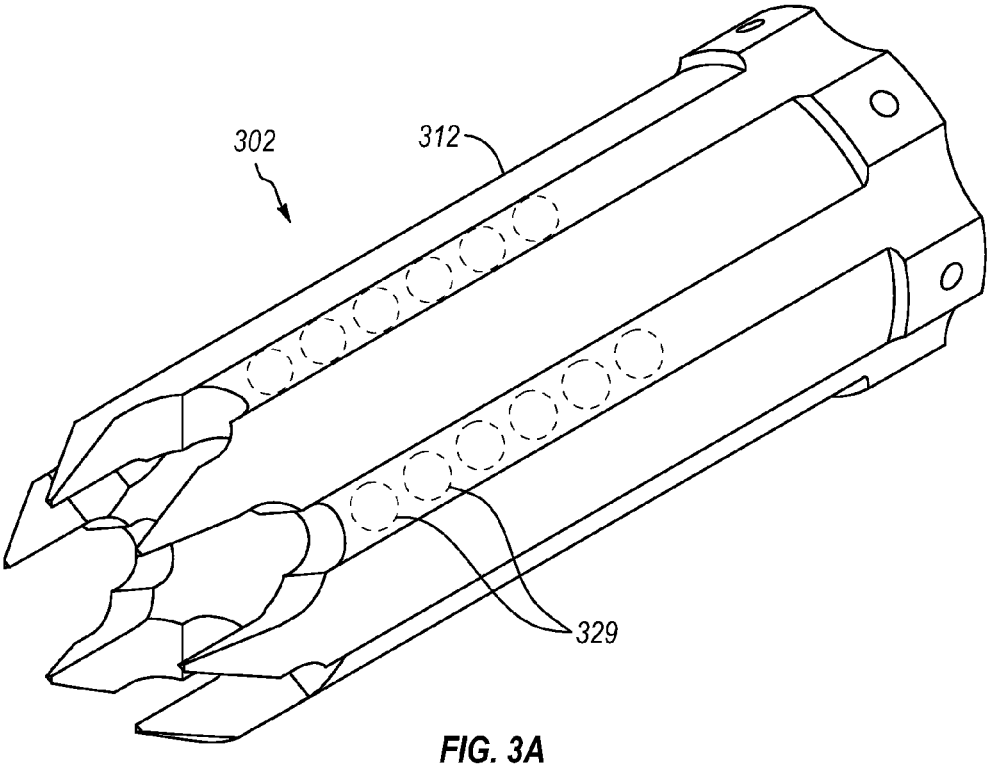
FIG. 3A is a front perspective view of a standoff device having a longer elongated body according to the present embodiment.
Figure 3B:
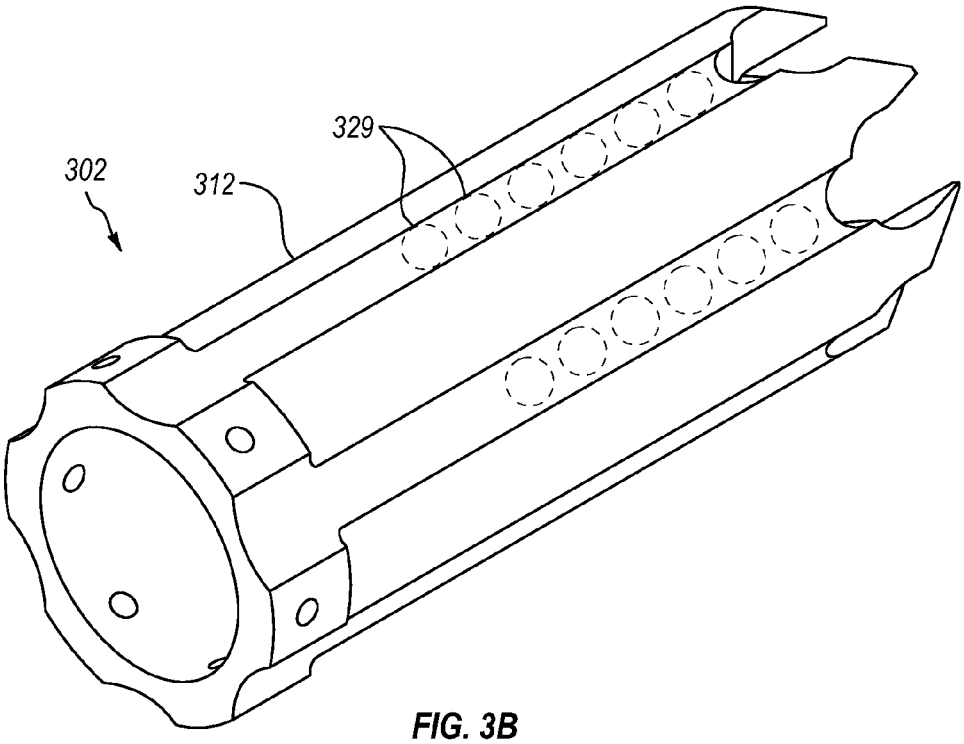
FIG. 3B is a rear perspective view of a standoff device having a longer elongated body according to the present embodiment.
Figure 3C:
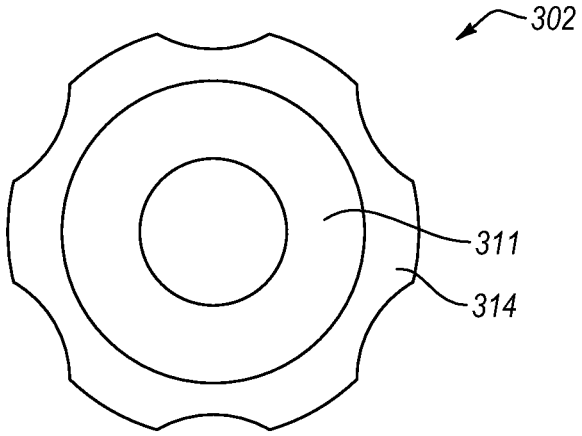
FIG. 3C is a bottom view of a standoff device having a longer elongated body according to the present embodiment.
Figure 3D:
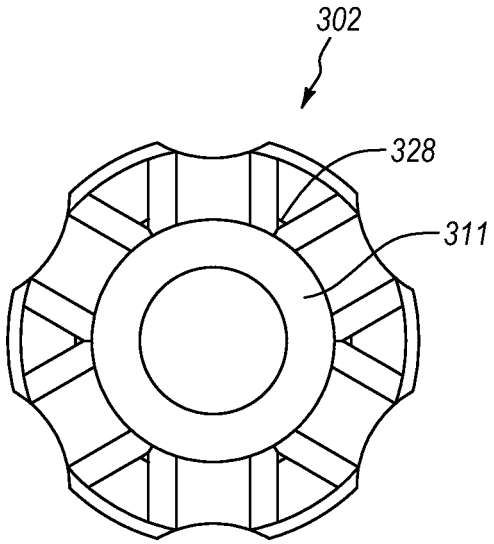
FIG. 3D is a top view of a standoff device having a longer elongated body according to the present embodiment.
Figure 3E:
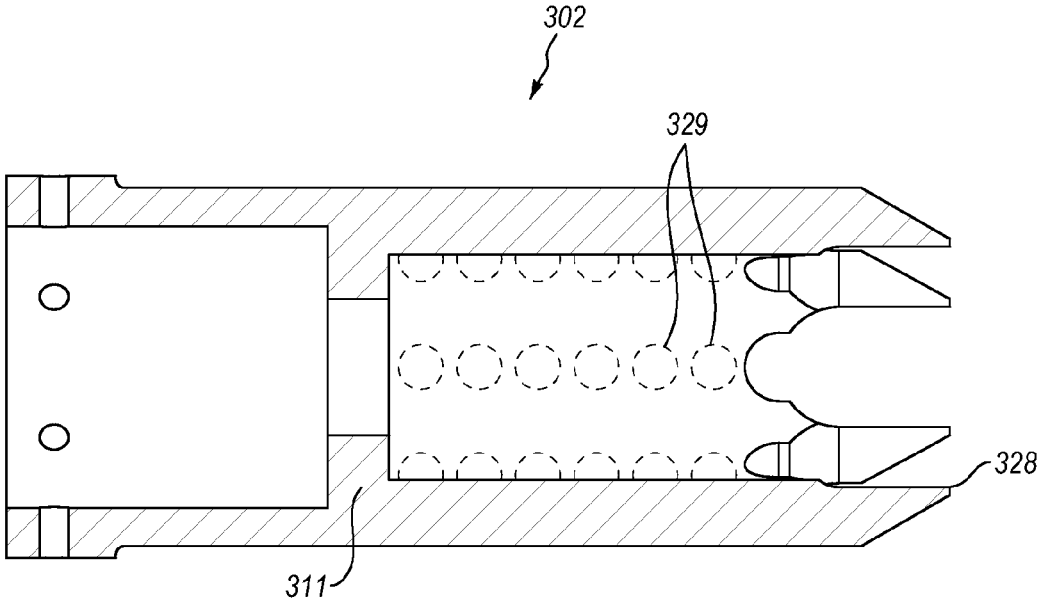
FIG. 3E is a cross-sectional side view of a standoff device having a longer elongated body according to the present embodiment.

As shown in FIGS. 1A, 1B, and 1E, the standoff device 102 may optionally include one or more ports 129 radially disposed about a circumference of the elongated body 112. The ports 129 may extend laterally through the elongated body 112 and provide fluid communication therethrough. Fluid communication may allow expanding gases to vent laterally and away from the gun barrel and user when the standoff device 102 is fixed to a gun barrel and the standoff device is adjacent another object. For example, during breaching of a door, the standoff device 102 may be placed adjacent a door when the gun is fired. The expanding gases from the round of the gun may be allowed to escape through the one or more ports 129 without placing additional stress on the gun barrel or other components, which may be dangerous for the gun or user. In an embodiment, the one or more ports 129 may be aligned with one or more recesses 116. In another embodiment, the one or more ports 129 may be aligned with one or more primary surfaces 120.

It should be appreciated that the exact configuration of these elements can be modified without departing from the purpose and spirit of the invention. For example, the recesses 116, if exhibited in a particular embodiment, may be shaped so as to be substantially semicircular and concave in shape, as shown in FIGS. 1A and 1B, or may be shaped with a substantially flat or convex bottom surface. The recesses may also extend from the extreme proximal end 104 of the device to the notches 124 at the distal end, as shown in FIG. 1B, or may begin and/or terminate at a different location or locations along the length of the standoff device 102. For example, the recesses 116 may be disposed starting at an area away from the collar 114 in the distal direction and running longitudinally therefrom to the notches 124 at the distal end 106 of the device, thereby prevailing entirely on the elongated body 112 of the device and not encroaching on the collar 114. Additionally, the primary surfaces 120 of the elongated body 112 may be substantially flat, as shown in FIG. 1A, or may have a curved surface contour, such as a surface contour that matches the overall circumferential contour of the elongated body 112, or may have other surface curvature or shapes. In other embodiments, the collar may be omitted.

As shown in FIG. 1C-E, the elongated body 112 may include an inner shoulder 111. The inner shoulder 111 may extend radially inward into the cylindrical bore 108. The inner shoulder 111 may be integrally formed with the elongated body 112. The inner shoulder 111 may be sized such that a gun component, such as a gun barrel, a magazine tube, or a magazine tube extension, may insert into the cylindrical bore 108 but may not advance beyond the inner shoulder 111. The inner shoulder 111 may be located a distance from the proximal end 104 of the standoff device 102. In an embodiment, the inner shoulder 111 may be located less than about 1.25 inches from the proximal end 104 of the standoff device 102. In another embodiment, the inner shoulder 111 may be located less than about 1.0 inch from the proximal end 104 of the standoff device 102. In yet another embodiment, the inner shoulder 111 may be located less than about 0.75 inches from the proximal end 104 of the standoff device 102. In a further embodiment, the inner shoulder 111 may be located less than about 0.50 inches from the proximal end 104 of the standoff device 102.

As shown in FIG. 1C-E, the elongated body may include a secondary shoulder 113. The secondary shoulder 113 may be sized such that a gun component, such as a gun barrel, a magazine tube, or a magazine tube extension, may insert into the cylindrical bore 108 and advance beyond the inner shoulder 111 but may not advance beyond the inner shoulder 111. The inner shoulder 111 may be located a distance from the proximal end 104 of the standoff device 102. In an embodiment, the inner shoulder 111 may be located less than about 1.25 inches from the proximal end 104 of the standoff device 102. In another embodiment, the inner shoulder 111 may be located less than about 1.0 inch from the proximal end 104 of the standoff device 102. In yet another embodiment, the inner shoulder 111 may be located less than about 0.75 inches from the proximal end 104 of the standoff device 102. In a further embodiment, the inner shoulder 111 may be located less than about 0.50 inches from the proximal end 104 of the standoff device 102.

It should also be appreciated that the device may be attached to a gun component such as a barrel or magazine tube extension through a variety of means. In the embodiment shown in FIGS. 1A-E, for example, the collar 114 of the standoff device 102 includes a plurality of attachment holes 134 radially placed along the circumferential perimeter of the collar 114. In the particular embodiment shown, the attachment holes 134 are bored or bored and tapped holes for accepting and engaging with set screws. The attachment holes 134 may be disposed through the raised perimeter surfaces 118 of the collar 114 or at other locations or in other radial and/or longitudinal patterns along the standoff device 102.

In another embodiment of a standoff device 202, as shown in FIGS. 2A-E, at least a portion of the inner circumferential surface of the cylindrical bore 208 may be a threaded circumferential surface 210 with internal threads such that the internal threads may engage with external threads such as those of a barrel or magazine tube extension. The standoff device 202 of FIGS. 2A-E is similar to the standoff device 102 of FIGS. 1A-E. Thus the description of the standoff device 102 of FIGS. 1A-E is incorporated herein by reference. Elements of the embodiment of the standoff device 102 of FIGS. 1A-E may be generally used with elements of the standoff device 202 of FIGS. 2A-E. For example, the various patterns and surfaces described in the standoff device 102 of FIGS. 1A-E may also be used in the standoff device 202 of FIGS. 2A-E. Thus, any permutation of the elements of the standoff device 102 of FIGS. 1A-E may be used in conjunction with the standoff device 202 of FIGS. 2A-E except where such a combination would not be possible. Thus, although the standoff device 202 of FIGS. 2A-E describes a threaded attachment, the set screw attachments of the standoff device 102 of FIGS. 1A-E may be used in conjunction with the standoff device 202 of FIGS. 2A-E.

In another embodiment, as shown in FIGS. 3A-E, the standoff device 302 includes an elongated body 312 having a length sufficient to extend beyond a barrel of a gun when the standoff device 302 is attached to a magazine tube or magazine tube extension of a gun. The standoff device 302 may optionally include a plurality of ports 329 that extend through the elongated body 312. The standoff device 302 may be attached to a barrel of a gun. In such a configuration, the 329 ports may provide venting for expanding gases.

The standoff device 302 may also be attached to a magazine tube, a magazine cap, a magazine extension, or other component of the gun. In a configuration with the standoff device 302 attached to a component of the gun other than the barrel, the ports 329 may reduce the weight of the standoff device 302. Weight reduction of the standoff device 302 may allow for easier handling of the gun during operation in confined spaces. Weight reduction of the standoff device 302 may also reduce the weight of the gun that an operator may need to support and steady, thereby reducing fatigue during operation. As with the standoff device 202 of FIGS. 2A-E, the standoff device 302 of FIGS. 3A-E may include components similar to components described in relation to FIGS. 1A through 2E. Thus, the descriptions of the embodiments of FIGS. 1A through 2E are hereby incorporated by reference.

Figure 4:
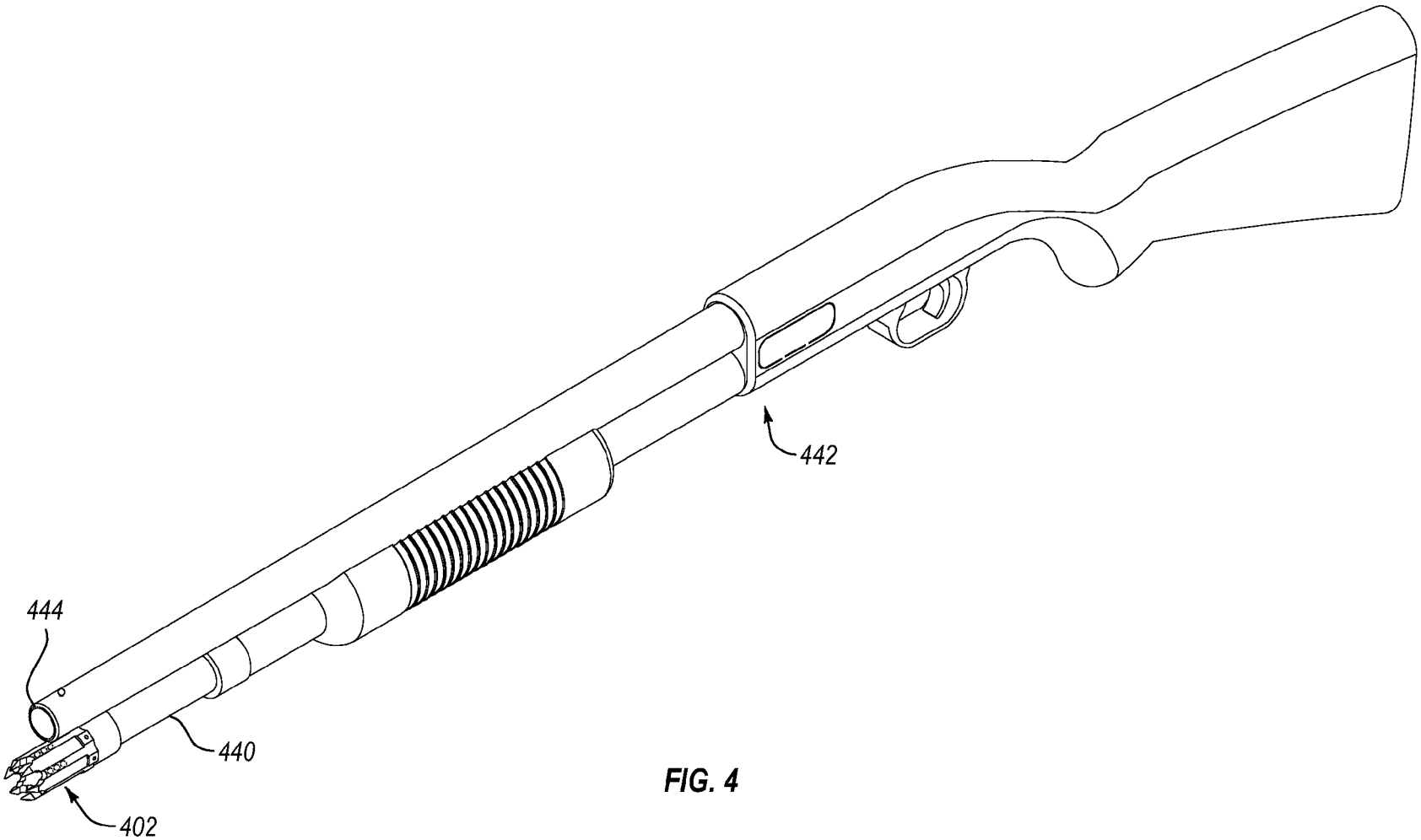
FIG. 4 is a perspective view of a standoff device having attachment holes attached to a magazine extension tube of a gun.

FIG. 4 is a representation of an embodiment of the standoff device 402 attached to the magazine tube extension 440 of a gun 442. In one embodiment, the standoff device 402 has a length that enables it to extend distally beyond the muzzle of the gun barrel 444 when it is attached, as shown. The standoff device 402 may include components similar to those of standoff device 102 described in FIGS. 1A-E. The particular embodiment shown in the figure is a standoff device 402 with a plurality of attachment holes 434 capable of engaging with set screws, the set screws thereby holding the standoff device 402 in position on the magazine tube extension 440.

In some embodiments, the standoff device 402 is disposed such that at least approximately ¼ of the length of the standoff device 402 extends beyond the barrel 444 of the gun 442. More preferably, at least approximately ⅓ of the length of the standoff device 402 extends beyond the barrel 444 of the gun 442. Even more preferably, at least approximately ½ of the length of the standoff device 402 extends beyond the barrel 444 of the gun 442. In other embodiments, substantially all of the length of the standoff device extends beyond the barrel 444 of the gun 442. In some embodiments, the standoff device 402 is adjacent to less than approximately ⅛ of the length of the barrel 444 of the gun 442. Preferably, the standoff device 402 is adjacent to less than approximately 1/12 of the length of the barrel 444 of the gun 442. More preferably, the standoff device 402 is adjacent to less than approximately 1/16 of the length of the barrel 444 of the gun 442. Even more preferably, the standoff device 402 is adjacent to less than approximately 1/20 of the length of the barrel 444 of the gun 442. In other embodiments, the standoff device 402 is not adjacent to any substantial length of the barrel 444 of the gun 42.

In some embodiments, for example the embodiment shown in FIG. 4, the standoff device is configured to extend beyond the barrel 444 of the gun 442 in order to provide a standoff distance that will keep the barrel a proper distance from a surface to be breached, such that combustion gasses can escape without causing damage to the gun or injury to the user. A proper distance may include, for example, a range of about 0.5 to 5 inches. More preferably, the distance may include a range of about 1 to 4 inches. More preferably, the distance may include a range of about 1 to 3 inches or about 1 to 2 inches. Even more preferably, the distance may include a range of approximately one inch. The use of the terms "about" and "approximately" in these ranges refers to a matter of precision of one significant digit. For example, a ratio of about one to three means between 0.5 and 1.5 and between 2.5 and 3.5. Otherwise, the terms "about" and "approximately" have their conventional meaning as understood by one of skilled in the art of standoff and breaching devices. As with the embodiments of FIGS. 2A through 3E, the embodiment of FIG. 4 is also similar to the embodiments of FIGS. 1A through 3E. Thus, the descriptions of the embodiments of FIGS. 1A through 3E are hereby incorporated by reference.

Figure 5:
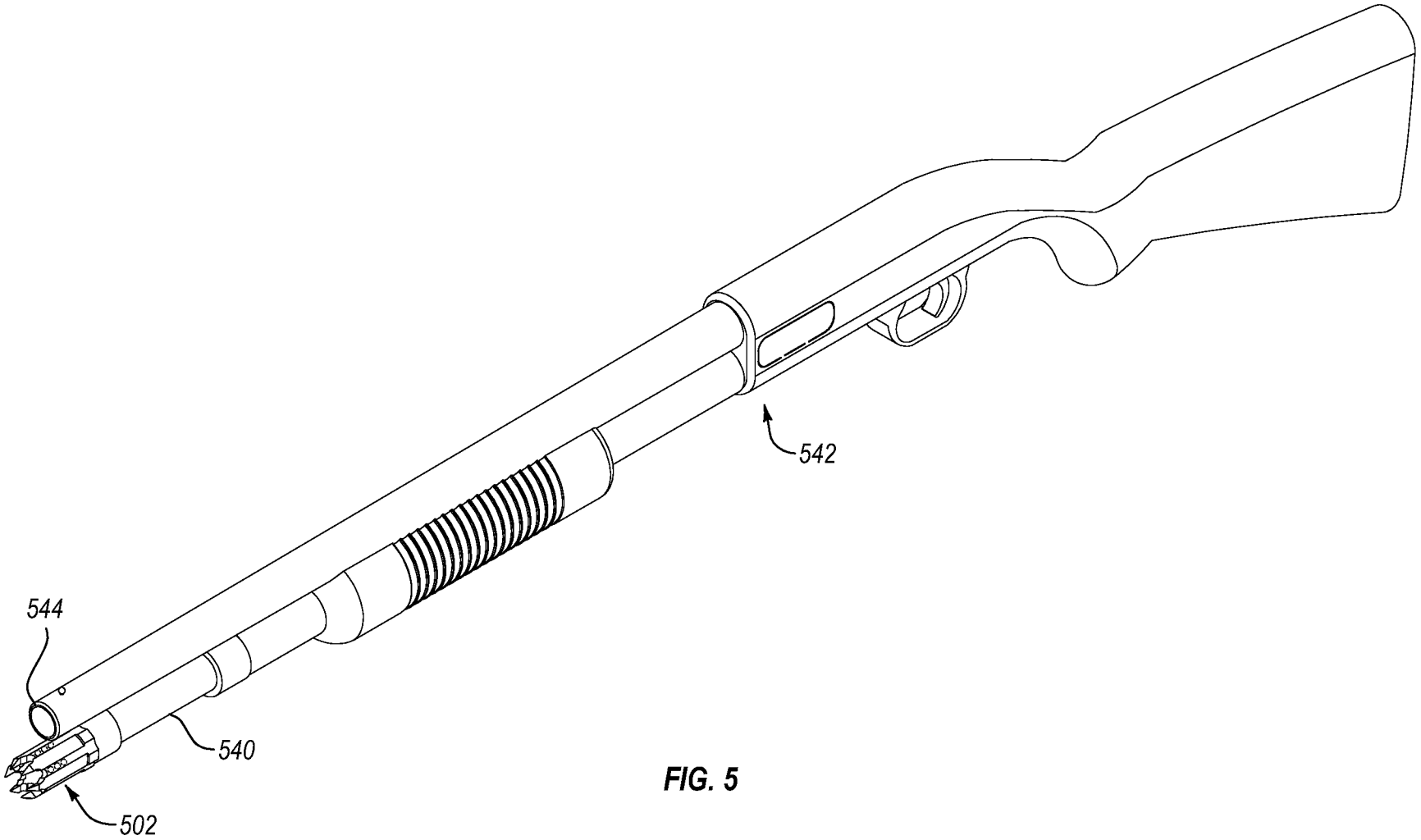
FIG. 5 is a perspective view of a standoff device having a threaded interior surface attached to a threaded magazine extension tube of a gun.
Figure 6A:
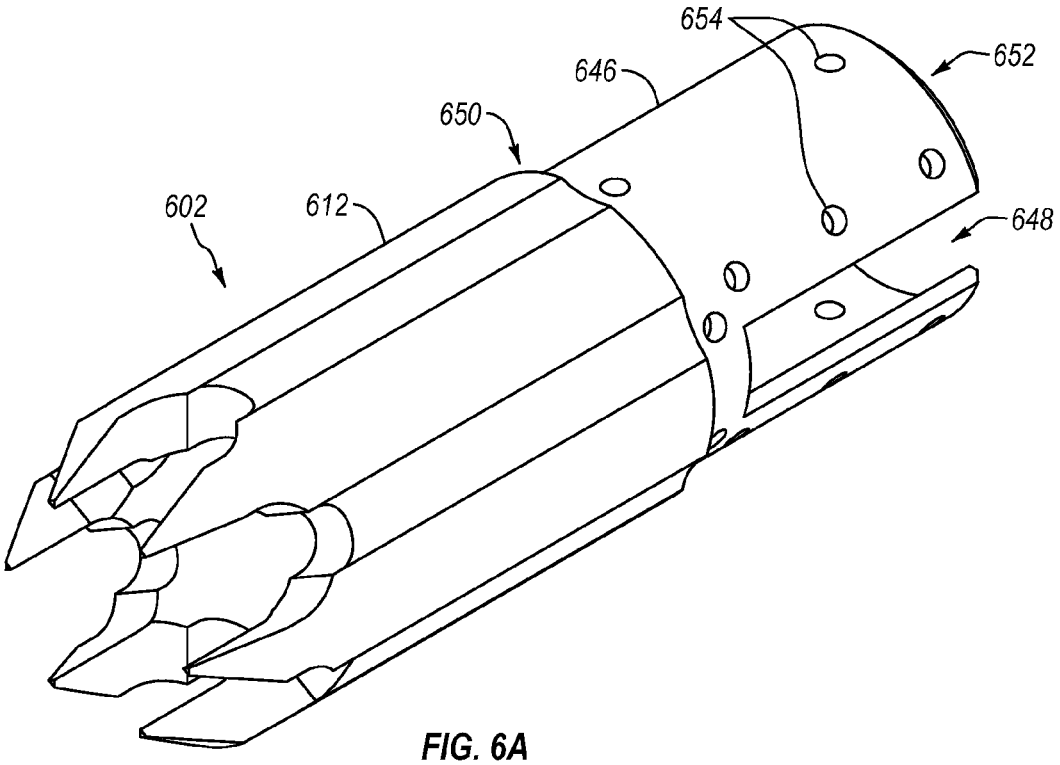
FIG. 6A is a front perspective view of a standoff device having an attachment skirt according to the present embodiment.
Figure 6B:
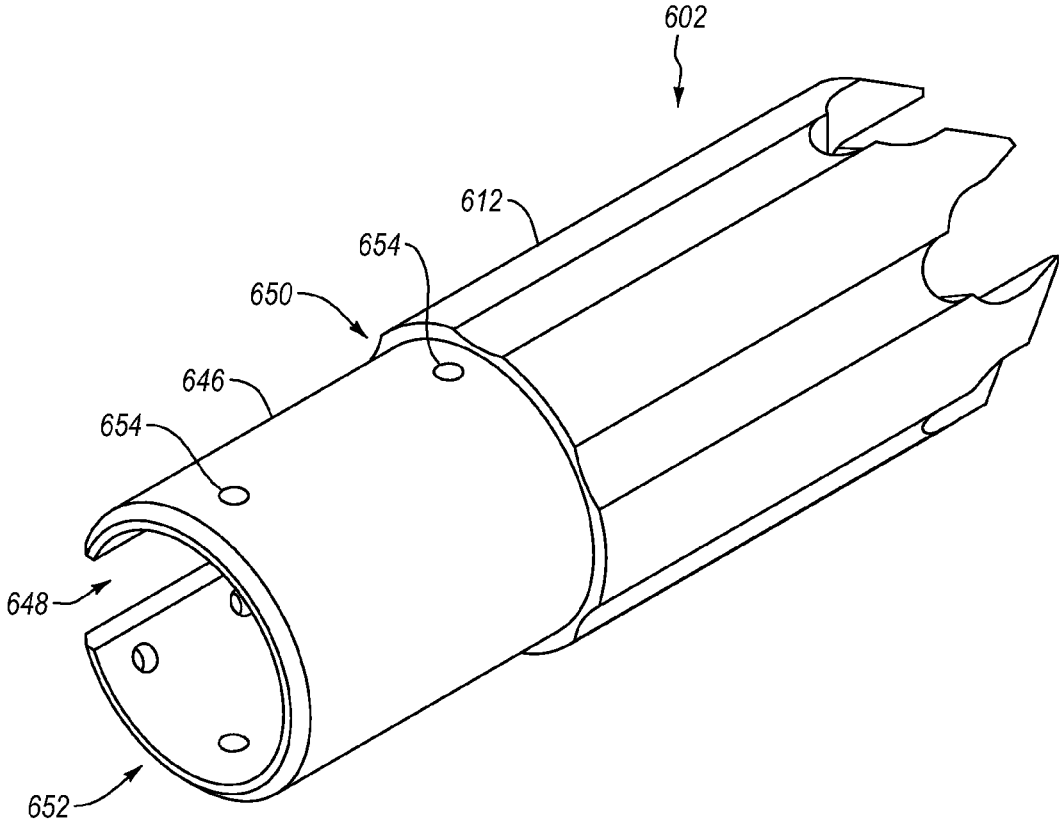
FIG. 6B is a rear perspective view of a standoff device having an attachment skirt according to the present embodiment.
Figure 6C:
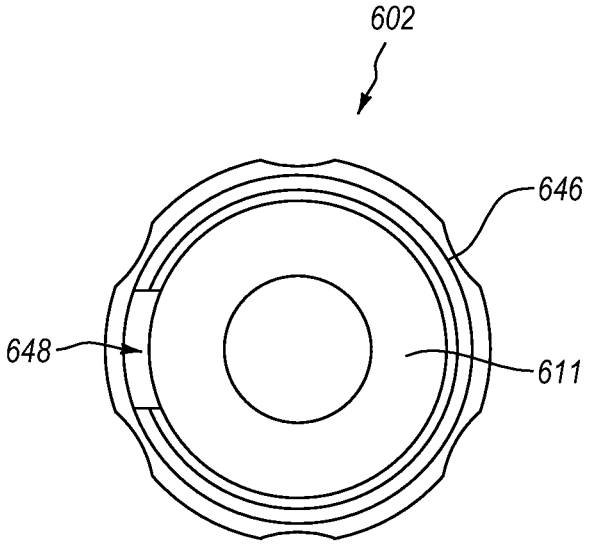
FIG. 6C is a bottom view of a standoff device having an attachment skirt according to the present embodiment.
Figure 6D:
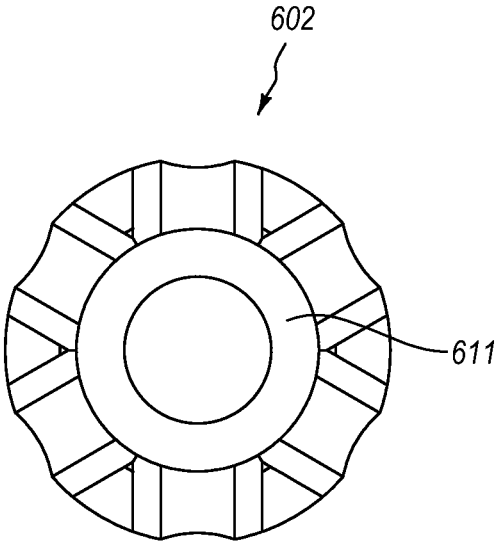
FIG. 6D is a top view of a standoff device having an attachment skirt according to the present embodiment.
Figure 6E:
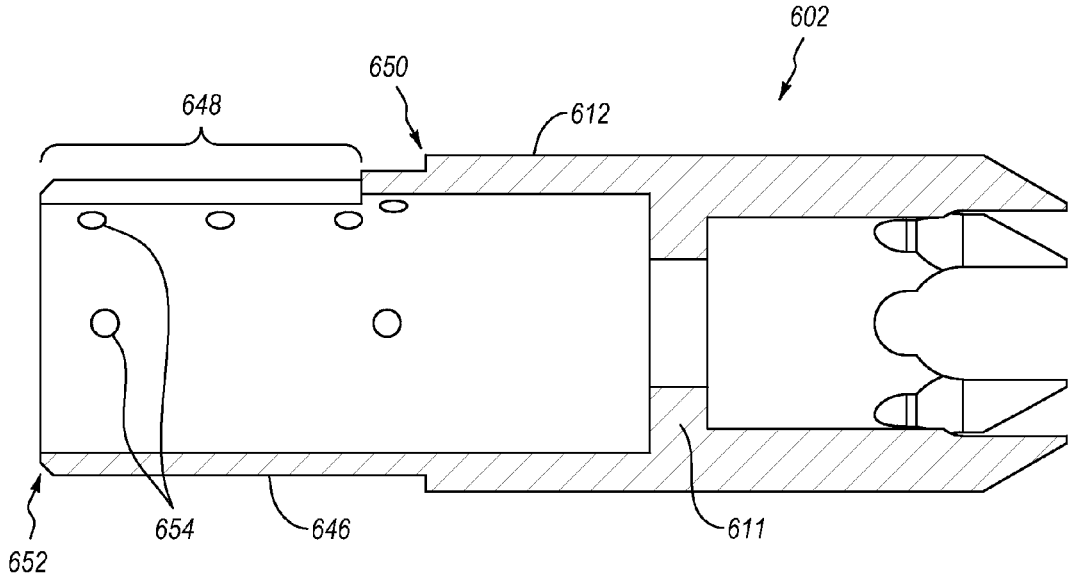
FIG. 6E is a cross-sectional side view of a standoff device having an attachment skirt according to the present embodiment.

FIG. 5 is another representation of an embodiment of the standoff device 502 attached to a magazine tube extension 540. The standoff device 502 may include components similar to those of standoff device 202 described in FIGS. 2A-E. FIG. 5 depicts a system wherein the standoff device 502 is attached to a gun 542 via engaging an internally threaded portion of the standoff device 502 with an externally threaded portion of the magazine tube extension 540. The standoff device 502 may also be attached by engaging an externally threaded extension (shown in FIG. 9) of the standoff device 502 with an internally threaded portion of the magazine tube extension 540. As with the embodiments of FIGS. 2A through 4, the embodiment of FIG. 5 is also similar to the embodiments of FIGS. 1A through 4. Thus, the descriptions of the embodiments of FIGS. 1A through 4 are hereby incorporated by reference.

FIGS. 6A-E depict an embodiment of the standoff device 602 adapted for attachment to the barrel of a gun. In the embodiment shown, the device includes an elongated body 612 without a collar, though a collar may optionally be provided in other embodiments. An attachment skirt 646 may be integrally formed or separately and concentrically connected to the device at the elongate body proximal end 650 (or collar proximal end in a collar exhibiting embodiment) and extending farther in the proximal direction.

The attachment skirt 646 may include a slot 648, enabling the standoff device 602 to be attached to the barrel of a gun without interference between the attachment skirt 646 and other components of the gun such as the magazine cap/screw, magazine tube, or magazine tube extension. The slot 648 may be disposed beginning at an area away from the elongated body 612 in the proximal direction and running longitudinally therefrom through the attachment skirt proximal end 652, thereby leaving the slot 648 open and unbounded at the attachment skirt proximal end 652. The width of the slot 648 (i.e. the amount of circumferential perimeter of the attachment skirt it prevails through) is chosen so as to allow sufficient clearance for any potentially interfering gun components (e.g. a magazine screw/cap, magazine tube extension, magazine tube extension barrel mount) while providing sufficient area of the attachment skirt 646 for attachment of the standoff device 602 to a gun. In some embodiments, the width of the slot may be smaller than the hemispherical circumference of the attachment skirt 646, such that, for example, only a small portion of the attachment skirt 646 extends beyond the halfway circumference of the barrel. In other words, more than half of the outer circumference of the barrel may be surrounded by an attached attachment skirt 646 such that the standoff device 602 is retained axially about the barrel.

The attachment skirt 646 may also include a plurality of attachment holes 654. In the embodiment shown in FIGS. 6A-E, the attachment holes 654 are bored holes that may, for example, be tapped to create threads for accepting and engaging with set screws. The attachment holes 654 are placed throughout the attachment skirt 646 so as to provide sufficient attachment to the barrel and to avoid unwanted loosening of the standoff device 602 once attached. The attachment holes 654 may be placed in a variety of locations on the attachment skirt 646 or other portions of the standoff device 602 and may be placed in any pattern or number of patterns in order to achieve sufficient attachment. For example, in the embodiment shown in FIGS. 6A-E, a first plurality of radial attachment holes is disposed along the circumference of the distal portion of the attachment skirt 646. Because the greatest distal extension of the slot 648 is short of the elongated body 612 in this particular embodiment, attachment holes 654 are available along the full circumference of the distal portion of the attachment skirt 646, including the area distally adjacent to the slot 648.

A second plurality of radial attachment holes is disposed along the circumference of the proximal portion of the attachment skirt, excepting any portion of the circumference of the proximal portion of the attachment skirt made discontinuous by the slot 648. Additionally, as shown in FIGS. 6A-E, a first plurality of longitudinal attachment holes is disposed adjacent to a first longitudinal contour of the slot 648, and a second plurality of longitudinal attachment holes is disposed adjacent to a second longitudinal contour of the slot 648. The longitudinal and radial paths exhibited by the pluralities of attachment holes intersect, and depending on the chosen number and spacing of attachment holes 654, an attachment hole 654 may be disposed at such an intersection point and may be a part of more than one of the pluralities of attachment holes. As with the standoff devices described in relation to FIGS. 1A through 5, the standoff device 602 of FIGS. 6A-E may include similar components to the embodiments of FIGS. 1A through 5. Thus, the descriptions of the embodiments of FIGS. 1A through 5 are hereby incorporated by reference.

Figure 7:
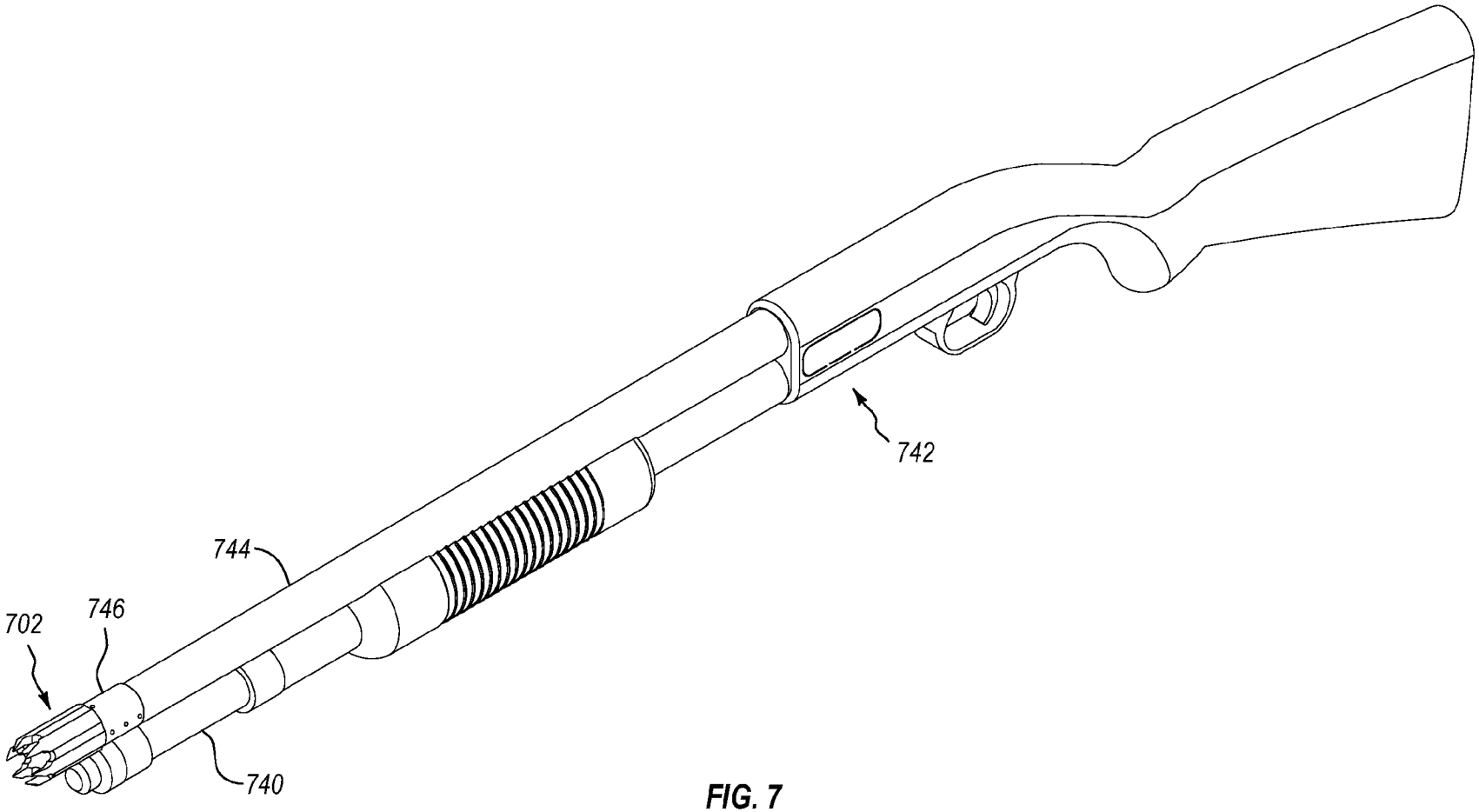
FIG. 7 is a perspective view of a standoff device having an attachment skirt attached to a barrel of a gun.

FIG. 7 is a representation of an embodiment of a standoff device 702 attached to the barrel 744 of a gun 742. The standoff device 702 may include an attachment skirt 746 similar to that described in relation to FIGS. 6A-E. In the embodiment shown, the slot 748 of the attachment skirt 746 enables the standoff device 702 to be placed or slid onto the barrel 744 such that the slot 748 keeps the remaining portions of the attachment skirt 746 from interfering with other components of the gun such as a magazine tube extension or the magazine screw/cap. As with the standoff devices described in relation to FIGS. 1A through 6, the standoff device 702 of FIG. 7 may include similar components to the embodiments of FIGS. 1A through 6. Thus, the descriptions of the embodiments of FIGS. 1A through 6 are hereby incorporated by reference.

Figure 8:
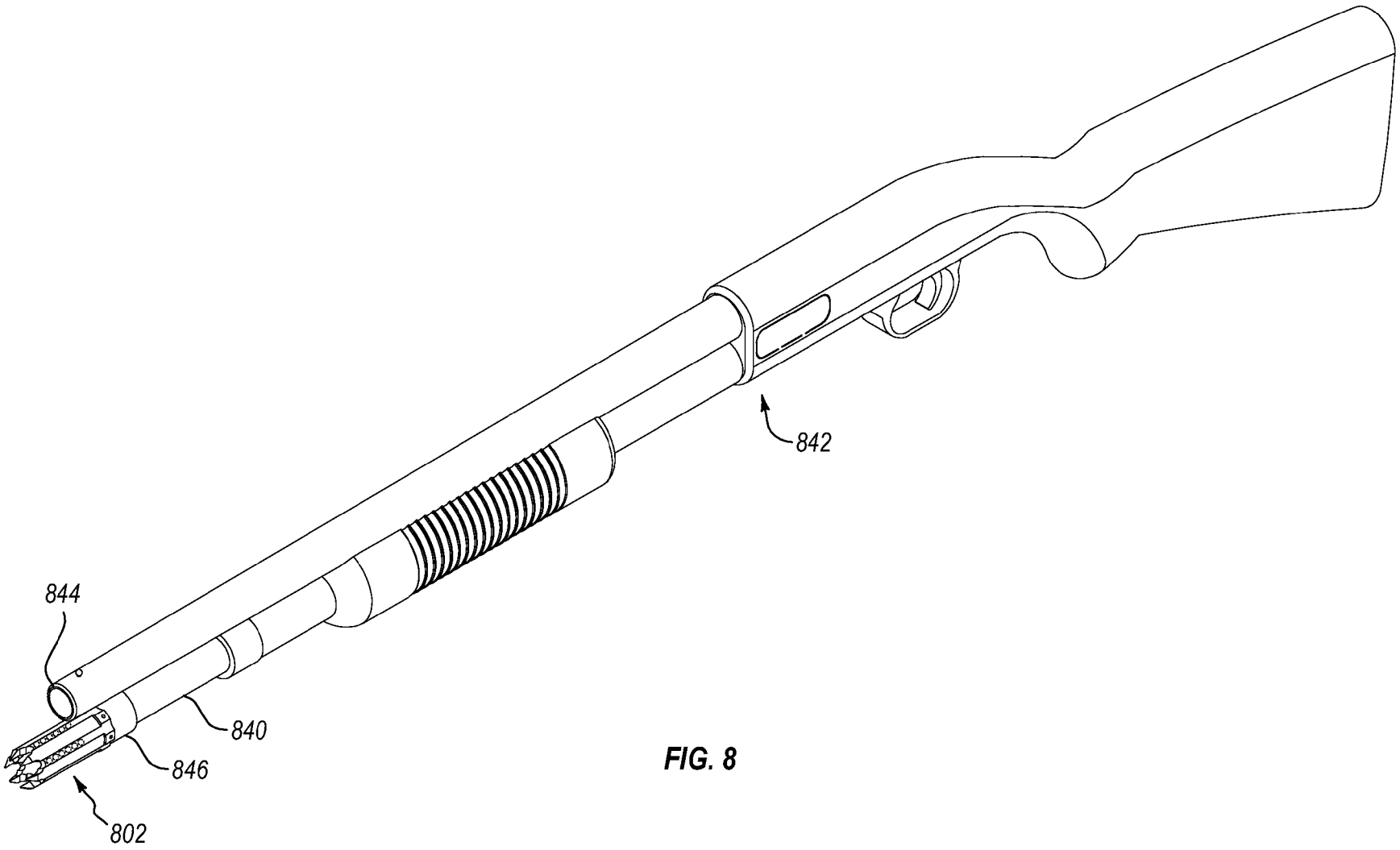
FIG. 8 is a perspective view of a standoff device having an attachment skirt attached to a magazine tube of a gun.
Figure 9A:
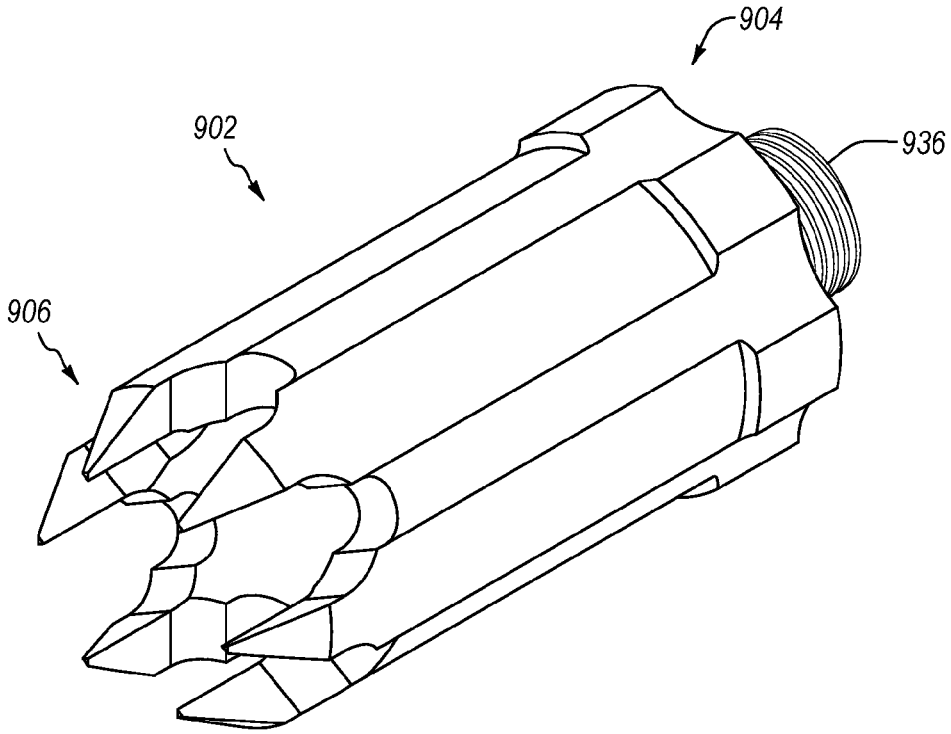
FIG. 9A is a front perspective view of a standoff device having an externally threaded extension according to the present embodiment.
Figure 9B:
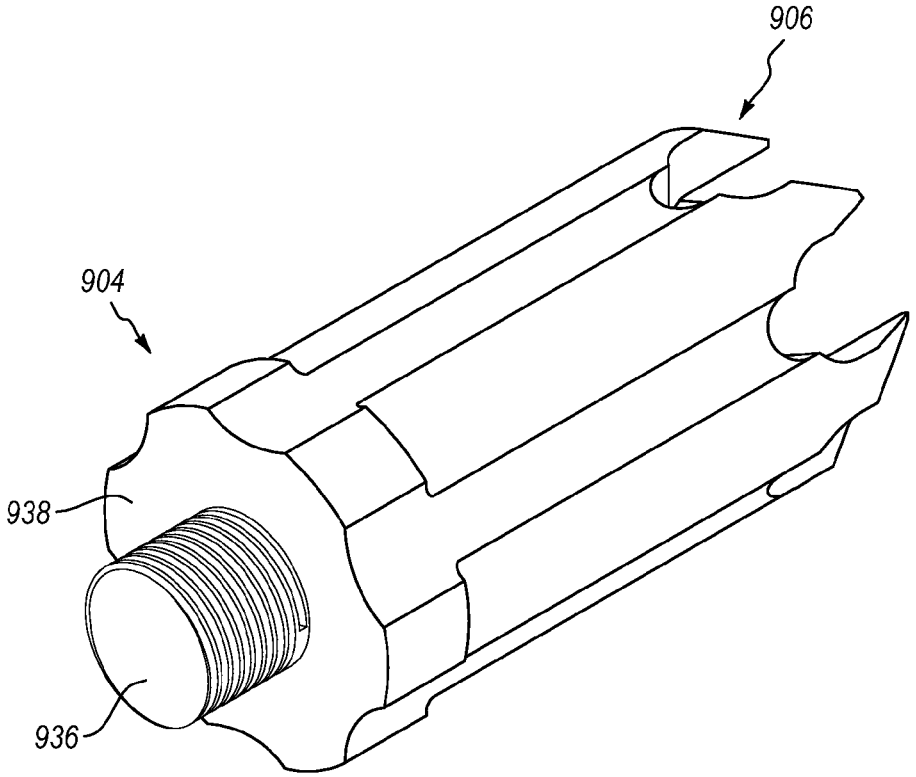
FIG. 9B is a rear perspective view of a standoff device having an externally threaded extension according to the present embodiment.
Figure 9C:
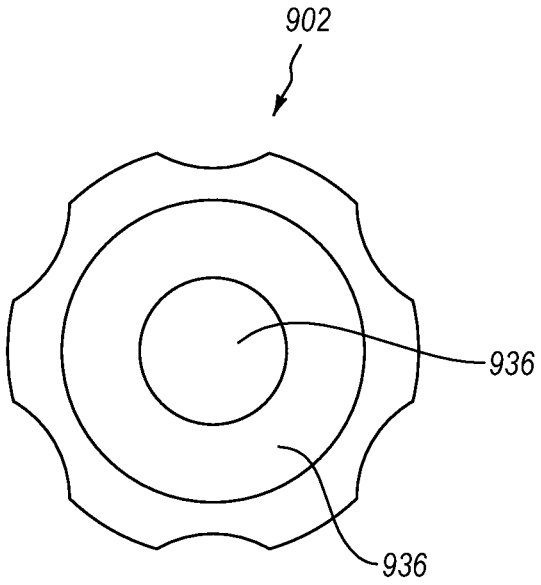
FIG. 9C is a bottom view of a standoff device having an externally threaded extension according to the present embodiment.
Figure 9D:
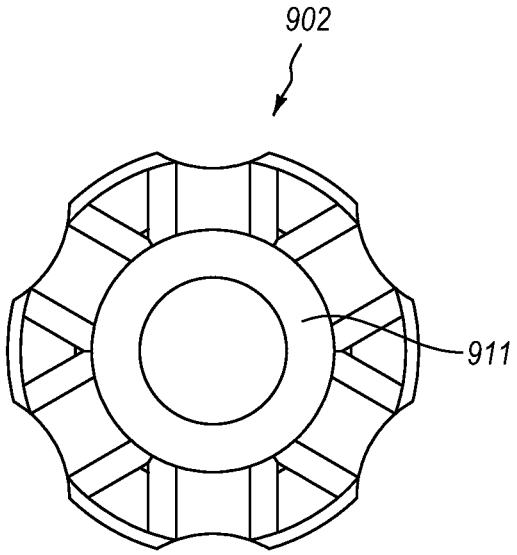
FIG. 9D is a top view of a standoff device having an externally threaded extension according to the present embodiment.
Figure 9E:
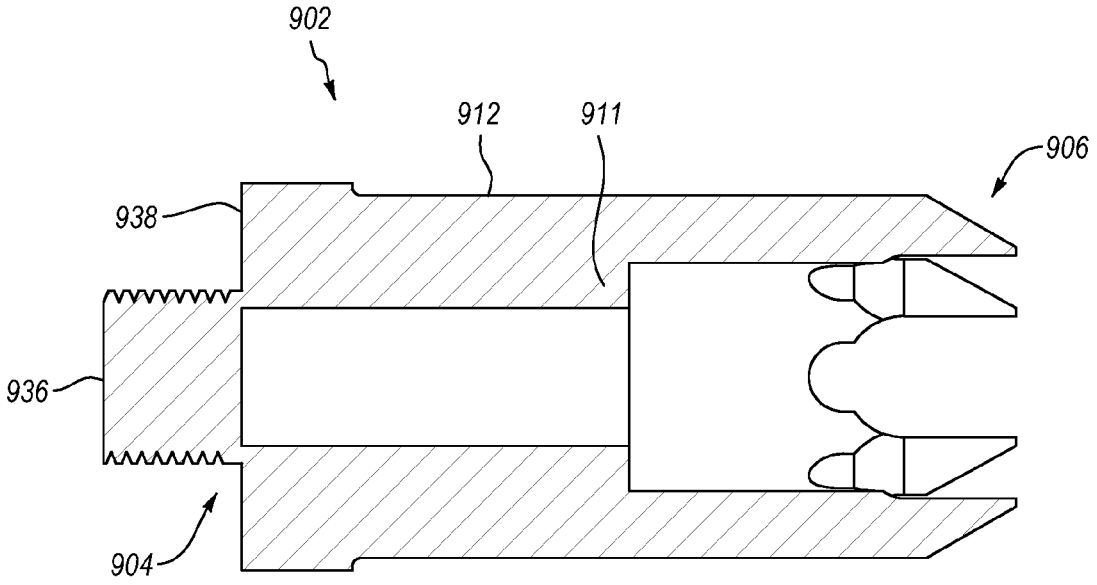
FIG. 9E is a cross-sectional side view of a standoff device having an externally threaded extension according to the present embodiment.

FIG. 8 depicts a standoff device 802 attached to a magazine extension tube 840 of a gun 842. The standoff device 802 may include an attachment skirt 846 similar to that described in relation to FIGS. 6A-E. The attachment skirt 846 may include a slot 848 (not visible) that allows the standoff device 802 to be placed or slid onto the magazine extension tube 840 such that the slot 848 keeps the remaining portions of the attachment skirt 846 from interfering with other components of the gun such as the gun barrel 844. As with the standoff devices described in relation to FIGS. 1A through 7, the standoff device 802 of FIG. 8 may include similar components to the embodiments of FIGS. 1A through 7. Thus, the descriptions of the embodiments of FIGS. 1A through 7 are hereby incorporated by reference.

In another embodiment, as shown in FIG. 9, the standoff device 302 includes an externally threaded extension 936. In the particular embodiment shown, the cylindrical bore 910 does not extend entirely through the standoff device 902 but stops short of the proximal end 904 such that the proximal end 904 includes a closed surface 938 parallel to the longitudinal axis of the device. The externally threaded extension 936 may be integrally formed with and connected to the closed surface 938, and may extend a distance from the closed surface 938 in the proximal direction. In other embodiments, the externally threaded extension 936 may be attached to the closed surface 938. The externally threaded extension 936 is preferably concentrically aligned with the standoff device 902 such that the longitudinal axis passing through the center of the standoff device 902 also passes through the center of the externally threaded extension 936. However, an off-center alignment between the standoff device 902 and the externally threaded extension 936 may be used. The external threads of the externally threaded extension 936 may engage with internal threads of a gun component such as those of a barrel or magazine tube extension as a means of attaching the standoff device 902 to a gun. As with the previous embodiments of standoff devices described in relation to FIGS. 1A through 8, the standoff device 902 of FIGS. 9A-E may include similar components to the embodiments of FIGS. 1A through 8. Thus, the descriptions of the embodiments of FIGS. 1A through 8 are hereby incorporated by reference.

In the description herein, various relational terms are provided to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," and the like, may be used to describe various components, including their operation and/or illustrated position relative to one or more other components. Relational terms do not indicate a particular orientation for each embodiment within the scope of the description or claims. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first," "second," "third," and the like may also be used to differentiate between identical components or between components which are similar in use, structure, or operation. Such language is not intended to limit a component to a singular designation. As such, a component referenced in the specification as the "first" component may be the same or different than a component that is referenced in the claims as a "first" component.

Furthermore, while the description or claims may refer to "an additional" or "other" element, feature, aspect, component, or the like, it does not preclude there being a single element, or more than one, of the additional element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral" or "integrally" formed include components made from the same piece of material, or sets of materials, such as by being commonly molded or cast from the same material, or commonly machined from the same piece of material stock. Components that are "integral" should also be understood to be "coupled" together.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features or elements from the various embodiments disclosed may be employed in combination with any other features or elements disclosed herein.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

What is claimed is:

1. A standoff device configured for a gun comprising:

an elongated body disposed between a proximal end and a distal end having a bore extending longitudinally therethrough, wherein the elongated body is circumferentially crenelated at the distal end so as to form a plurality of radially disposed tooth members; and at least one attachment structure at the proximal end, the attachment structure configured to attach to a magazine tube or magazine tube extension; and wherein the radially disposed tooth members have angled outer surfaces that slope radially inward toward the distal end to form tooth end points and the angled outer surfaces are rotationally aligned with the tooth end points such that the device may be used as a close-quarters weapon.

2. The device of claim 1, further comprising a collar, the collar being disposed at the proximal end of the elongated body and extending a distance proximally.

3. The device of claim 1, further comprising one or more ports disposed through the elongated body and providing fluid communication therethrough.

4. The device of claim 1, further comprising a plurality of recesses radially disposed along at least a portion of an outer circumferential surface of the device.

5. The device of claim 1, wherein the elongated body is configured to extend beyond a barrel of the gun.

6. The device of claim 1, wherein the attachment structure includes an internally threaded portion that engages an externally threaded portion of the magazine tube or magazine tube extension or an externally threaded portion that engages an internally threaded portion of the magazine tube or magazine tube extension.

7. The device of claim 1, wherein a length to diameter ratio of the standoff device is about five to one.

8. The device of claim 1, wherein a length to diameter ratio of the standoff device is between about two to one to about four to one.

9. The device of claim 1, wherein a length to diameter ratio of the standoff device is about three to one.

10. The device of claim 1, wherein the magazine tube or magazine tube extension includes a magazine cap.

11. A standoff device configured for a gun comprising:

an elongated body disposed between a proximal end and a distal end having a bore extending longitudinally therethrough, wherein the elongated body is circumferentially crenelated at the distal end so as to form a plurality of radially disposed tooth members, sides of the tooth members formed by spaced notches having multiple curved contours, each contour increasing in curvature toward the distal end such that the device may be used as a close-quarters weapon; and wherein the radially disposed tooth members have angled outer surfaces that slope radially inward toward the distal end to form tooth end points such that the device may be used as a close-quarters weapon.

12. The device of claim 11, further comprising an attachment structure that includes a collar, the collar having at least one attachment hole located therein.

13. The device of claim 12, wherein the at least one attachment hole is configured on a raised perimeter surface of the collar.

14. The device of claim 12, wherein the collar comprises an alternating configuration of recesses and raised perimeter surfaces, each raised perimeter surface having at least one attachment hole.

15. The device of claim 11, further including an inner shoulder integrally formed with the elongated body and extending radially inward into the bore, a secondary shoulder integrally formed with the elongated body and extending radially inward into the bore a greater distance than the inner shoulder, such that an attachment structure is configured to receive a barrel of a gun or a magazine tube extension that is stopped by either the inner shoulder or secondary shoulder.

16. A standoff device configured for a gun comprising:

an elongated body disposed between a proximal end and a distal end having a bore extending longitudinally therethrough, wherein the elongated body is circumferentially crenelated at the distal end so as to form a plurality of radially disposed tooth members, sides of the tooth members formed by spaced notches having multiple curved contours, each contour increasing in curvature toward the distal end such that the device may be used as a close-quarters weapon; and at least one attachment structure at the proximal end, the attachment structure configured to attach to a magazine tube or magazine tube extension, the attachment structure includes an internally threaded portion that engages an externally threaded portion of a gun component or an externally threaded portion that engages an internally threaded portion of a gun component.

17. The device of claim 16, further including an inner shoulder integrally formed with the elongated body and extending radially inward into the bore, a secondary shoulder integrally formed with the elongated body and extending radially inward into the bore a greater distance than the inner shoulder, such that an attachment structure is configured to receive a barrel of a gun or a magazine tube extension that is stopped by either the inner shoulder or secondary shoulder.

18. The device of claim 16, wherein the elongated body is configured to extend beyond a barrel of the gun.

19. The device of claim 16, wherein the radially disposed tooth members comprise angled outer tooth surfaces which slope radially inward in a distal direction.

* * * * *